US005581909A

United States Patent [19]

Ueda et al.

[11] Patent Number: 5,581,909

[45] Date of Patent: Dec. 10, 1996

[54] HEAT TREATMENT APPARATUS FOR YARN

[75] Inventors: Kunihiko Ueda; Takao Sano; Shuko Arakane, all of Ohtsu, Japan

[73] Assignee: Toray Industries, Inc., Tokyo, Japan

[21] Appl. No.: 211,267

[22] PCT Filed: Aug. 5, 1992

[86] PCT No.: PCT/JP92/01000

§ 371 Date: Jul. 27, 1994

§ 102(e) Date: Jul. 27, 1994

[51] Int. Cl.[6] ..... F26B 13/00

[52] U.S. Cl. ..... 34/636; 34/629; 432/59

[58] Field of Search ..... 34/83, 84, 87, 34/90, 94, 611, 618, 623, 627–29, 636; 432/11, 17, 209, 59

[56] References Cited

U.S. PATENT DOCUMENTS 2,622,961 12/1952 Finlayson et al. ..... 34/83

3,554,502 1/1971 Rye et al. ..... 427/542

3,778,909 12/1973 Ostertag et al. ..... 34/636

*Primary Examiner*—John M. Sollecito

*Assistant Examiner*—Steve Gravini

*Attorney, Agent, or Firm*—Nikaido, Marmelstein, Murray & Oram LLP

[57] ABSTRACT

A heat treatment apparatus for yarn including a plurality of heat treatment apparatuses provided for a plurality of spindles, respectively, disposed at horizontally spaced intervals. The heat treatment apparatus provided for each of the spindles, includes a heat treatment tube through which at least one yarn passes, and a heat insulating jacket to surround the tube. An orifice having a throttling function is provided upstream of a part which provides communication between the heat insulating jacket and the heat treatment tube, while a nozzle for injecting a heated fluid is provided in the heat treatment tube downstream of the communication part. The throttling orifice is arranged to have a fluid resistance greater than the fluid resistance of the nozzle.

11 Claims, 5 Drawing Sheets

HEAT TREATMENT APPARATUS FOR YARN

TECHNICAL FIELD

The present invention relates to a heat treatment apparatus for yarn and, more particularly, to a heat treatment apparatus for treating a thermoplastic synthetic fiber, such as polyester, nylon 6 or nylon 66, by a heated fluid, such as steam.

BACKGROUND ART

Steam, which has the advantage of being capable of heating an object extremely rapidly by its condensation heat transmission effect, has conventionally been widely used in applications such as a heat-stretching or heat-fixing step in a synthetic fiber producing process. However, although steam has such an advantage, the following various problems are pointed out in terms of handling.

A first problem is that since the nature of steam greatly varies with pressure, it is difficult to utilize the steam without precisely managing pressure control. In particular, if yarn is to be treated with steam having a low pressure close to atmospheric pressure, the management of pressure control becomes far more difficult. However, since there has conventionally been no means for positively managing pressure control, an operator has no choice but to make a check for abnormality by periodic inspection.

A second problem is that steam is easy to condense. If condensation occurs in a pipe or an apparatus, the liquid water condensate is injected into a heat treatment area in which to heat-treat yarn, so that spots are formed on the yarn and yarn quality is degraded.

A third problem, which is associated with the first problem is that if a multiplicity of yarns are to be respectively heat-treated by heat treatment apparatuses provided for a multiplicity of spindles, it is extremely difficult to reduce differences among the spindles with regard to the pressure, temperature, flow rate and the like of steam. Since it is difficult to eliminate such differences among the spindles merely by improving the precision of production of the apparatuses or the manner of piping, it has been our practice to unwillingly accept some differences in yarn quality among the spindles.

DISCLOSURE OF INVENTION

A primary object of the present invention is to provide a heat treatment apparatus for yarn which is capable of substantially preventing differences from occurring among spindles with regard to the pressure, temperature, flow rate and the like of a heated fluid even if a plurality of heat treatment apparatuses are constituted by heat treatment areas required for a plurality of spindles.

Another object of the present invention is to provide a heat treatment apparatus which is capable of facilitating a threading operation for rethreading yarn after the occurrence of a yarn break or the like, and does not need any complicated operation, such as the operations of starting and stopping supply of a heated fluid or readjustment, each time the yarn threading operation is performed.

The present invention which has been made to achieve the primary object provides a heat treatment apparatus for yarn including heat treatment apparatuses provided for a plurality of spindles disposed at horizontally spaced intervals. The heat treatment apparatus provided for each of the plurality of spindles comprises: (a) a heat treatment tube having in its inside a heat treatment area through which to pass yarn; (b) a heat insulating jacket provided in such a manner as to surround the heat treatment tube; (c) a supply pipe connected so as to supply a heated fluid to the heat insulating jacket; (d) pressure regulating means provided on the supply pipe in such a manner as to be common to the main supply pipe and to the sub supply pipes respectively connected to heat insulating jackets of a plurality of other heat treatment apparatuses; (e) a nozzle provided downstream of a part which provides communication between the heat insulating jacket and the heat treatment tube, the nozzle having an injection opening which is open to the heat treatment area of the heat treatment tube and having, in its inside, means for straightening the heated fluid; and (f) an orifice provided upstream of the part which provides communication between the heat insulating jacket and the heat treatment tube, the orifice having a fluid resistance greater than a fluid resistance which the nozzle has.

In the above-described arrangement, the heat insulating jacket functions as a condensate separator and performs separation of condensate, rust or the like contained in a heated fluid (steam), and the heated fluid is adjusted to a constant flow and reduced in pressure by the throttling function of the orifice for each spindle, and the obtained heated fluid is supplied to the heat treatment area. Accordingly, if the primary pressure of the heated fluid to be supplied to each of the heat insulating jackets for a plurality of spindles is controlled by the common pressure regulating valve, it is possible to inject the heated fluids into the heat treatment areas for the respective spindles at mutually equivalent, constant flow rates which do not differ among the spindles.

The above other object of the present invention can be readily achieved by providing the orifice with a valve for opening and closing the orifice. Further, by providing an opening, which extends along a running direction of yarn, on one side of the heat treatment tube as well as a door for opening and closing the opening, it is possible to facilitate a yarn threading operation for rethreading yarn if a yarn break or the like occurs.

In the following description of an embodiment of the present invention, reference will be made to steam as a representative example of the heated fluid. However, it is also possible to use heated air or other heated inactive gases in addition to steam.

BEST MODE FOR CARRYING OUT THE INVENTION

Figure 1:
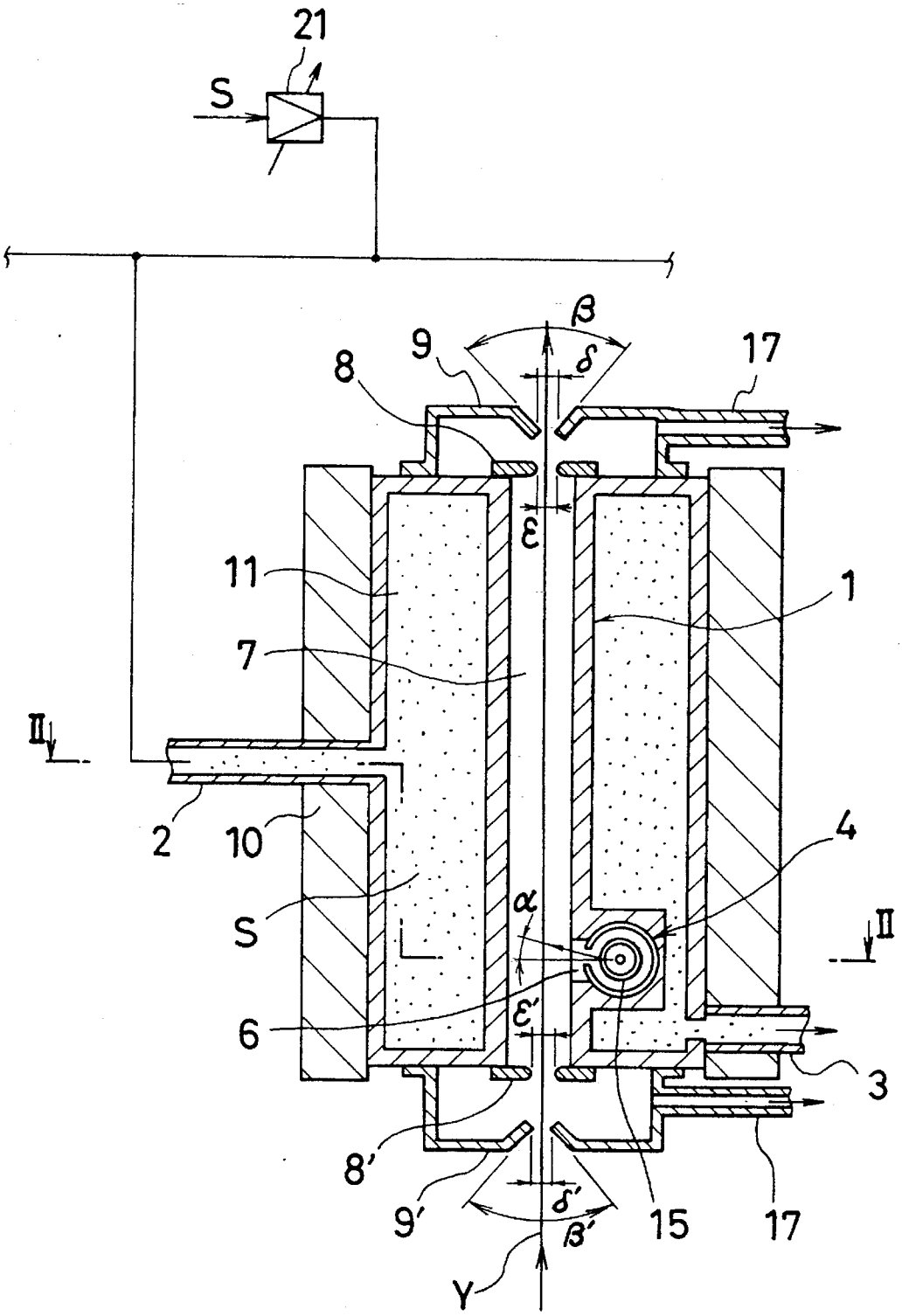
FIG. 1 is a longitudinal sectional view, taken along the direction of yarn running, of a heat treatment apparatus for yarn according to an embodiment of the present invention.
Figure 2:
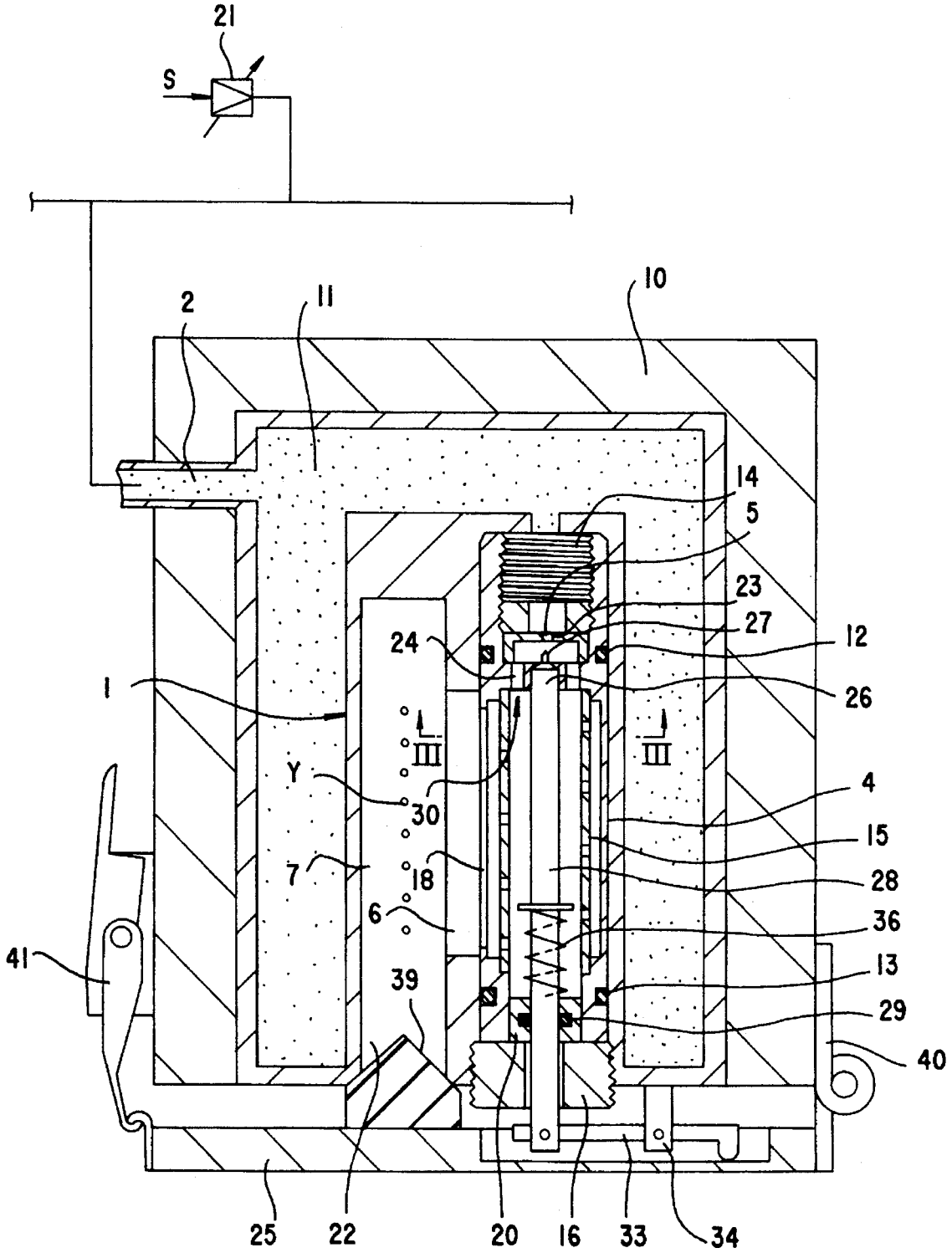
FIG. 2 is a cross-sectional view taken along line II—II of FIG. 1.

FIGS. 1 and 2 show a heat treatment apparatus for yarn, which is provided for one spindle alone. In the present invention, as many heat treatment apparatuses as there are number of spindles are horizontally disposed in a line at evenly spaced intervals.

This heat treatment apparatus for yarn has a heat treatment tube 1, and a heat treatment area 7, through which to pass yarn Y is formed inside the heat treatment tube 1. The yarn Y, may also be a plurality of filaments arrayed in the belt-like form shown in FIG. 2 or in a bundle-like form. Otherwise, a single mono-filament may also be used.

In the example shown in FIG. 2, the cross-sectional shape of the heat treatment area 7 is rectangular so that the yarn y is allowed to run in the belt-like form. The cross-sectional shape of the heat treatment area 7 is not limited to such a rectangle, and may be formed into an arbitrary shape, such as an elliptical or circular shape, according to the form of the yarn Y. It is desirable that the cross-sectional shape of the heat treatment area 7 be selected to provide a shape or volume which allows a steam injection opening 18 which is provided in the internal wall of the heat treatment tube 1 to retain as equal a distance as possible with respect to the yarn Y, and which allows steam which, after injected, accompanies the yarn Y to be charged into the heat treatment area 7 at an approximately uniform concentration.

The heat treatment area 7 is surrounded by a heat insulating jacket 11, and the heat insulating jacket 11 is surrounded by a heat insulating material 10. A supply pipe 2 through which to supply steam S is connected to the heat insulating jacket 11, and a drain pipe 3 through which to discharge waste steam and drain is connected to the bottom side of the heat insulating jacket 11.

On the upstream side of the supply pipe 2, there is provided a pressure regulating valve 21 which is common to the supply pipe 2 and supply pipes (not shown) which are respectively connected to the heat insulating jackets of other individual heat treatment apparatuses provided for the other spindles. Pressurized saturated steam which is controlled in advance is supplied to each of the heat insulating jackets 11 by the pressure regulating valve 21. The heat insulating jacket 11 has a heating and insulating function, and also has a drain separating function owing to its volume which is larger than that of the supply pipe 2. To increase both of the functions, fins (not shown) may be provided on the internal wall of the heat insulating jacket 11.

The heat insulating jacket 11 communicates with the heat treatment area 7 of the heat treatment tube 1 in a communication portion, and an orifice 5 for metering the flow of steam is inserted on the upstream side of the communication portion, while a nozzle 4 for injecting steam into the heat treatment area 7 is inserted on the downstream side.

The nozzle 4 has a cylindrical shape, and has a slitshaped steam injection opening 18 on one side. The steam injection opening 18 is formed to face the heat treatment area 7 via a pocket 6 which is opened in the internal wall of the heat treatment tube 1. Also, a tube-shaped flow straightening part 15 having a multiplicity of holes inside it is concentrically provided in the inside of the nozzle 4. The steam supplied through the orifice 5 is uniformly distributed by being straightened by the flow straightening part 15, and is then injected into the heat treatment area 7 through the steam injection opening 18.

The nozzle 4 is inserted in the heat treatment tube 1 in the state of being surrounded by the heat insulating jacket 11, and is removably secured by a plug 16. The nozzle 4 is sealed at its opposite ends by O-rings 12 and 13 so that the steam is prevented from leaking from the heat treatment tube 1. It is desirable that the shape of the nozzle 4 be selected to be cylindrical so that the nozzle 4 can maintain good sealing even if it is removably secured to the heat treatment tube 1. However, a block shape may be adopted as required. If the nozzle 4 is formed into a cylindrical shape, it is possible to provide the advantages that the nozzle 4 can be readily replaced merely by removing the plug 16 and that it is possible to employ a commercially available O-ring to prevent leakage of steam.

The shape of the steam injection opening 18 of the nozzle 4 may not necessarily be a slit as in the shown example; a multiplicity of holes may be arrayed in a line. If the steam injection opening 18 is to be formed as the array of a multiplicity of holes, it is preferable to select the diameter of each of the holes from a range of 1–6 mm and the pitch of the array from a range of 1–10 mm. The lengthwise distribution of the open area of the steam injection opening 18 may be uniform along the length of the nozzle 4. However, by varying the distribution of the open area, it is also possible to uniformly charge steam into the heat treatment area 7.

Figure 5:
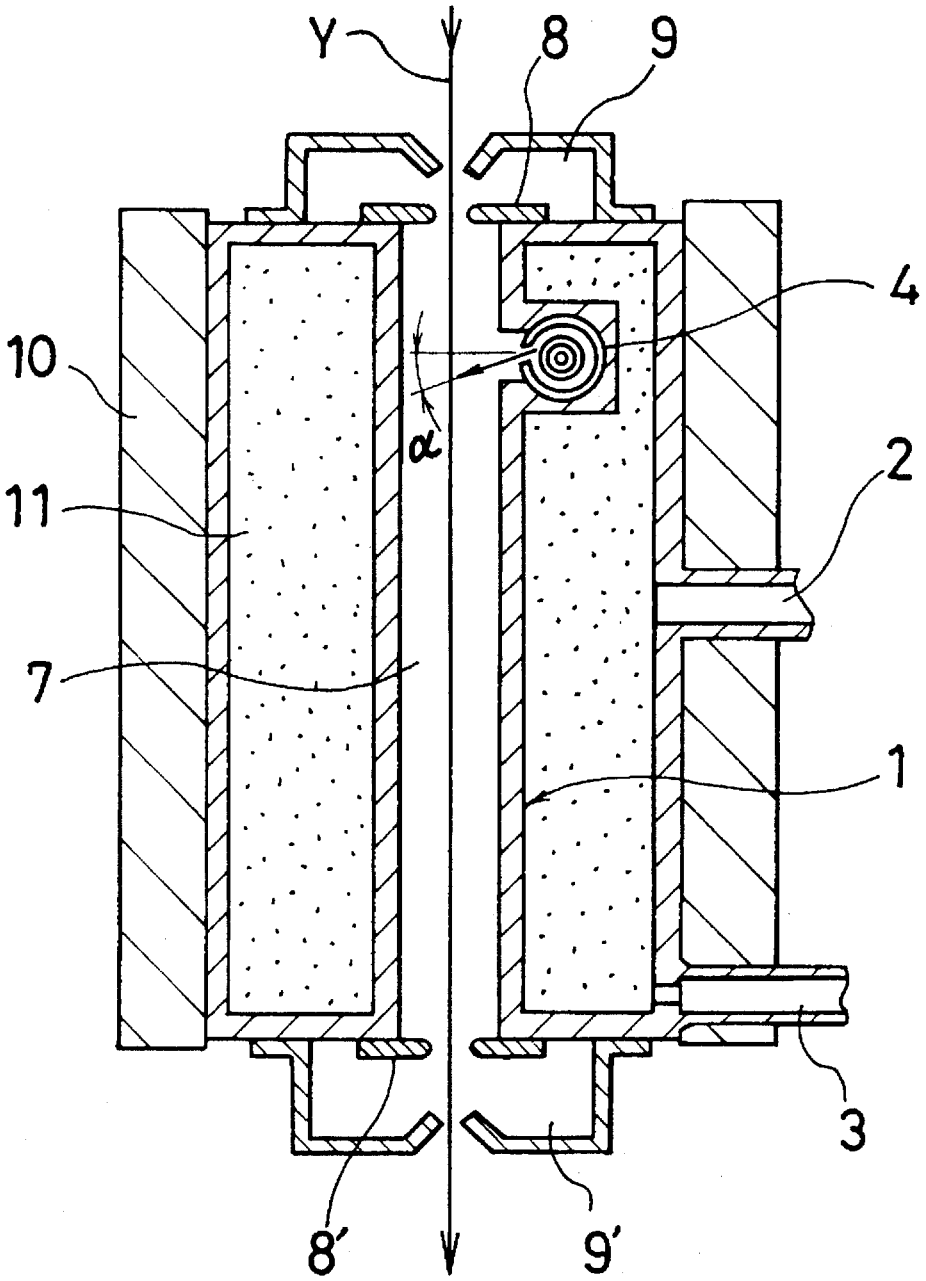
FIG. 5 is a longitudinal sectional view, taken along the direction of yarn running, of a heat treatment apparatus for yarn according to another embodiment of the present invention.

Although in the embodiment of FIG. 1 the nozzle 4 is provided at only one location on one side of the yarn Y, such a nozzle may be provided at a plurality of locations along the running direction of the yarn Y. Otherwise, such a nozzle may be provided at a plurality of locations on both sides of the yarn Y along the running direction thereof. Although the running direction of the yarn Y is selected so that the yarn Y runs upward in the heat treatment area 7, the yarn Y may also be made to run downward, as in the embodiment shown in FIG. 5. In the latter case, to inject steam from the upstream side of the yarn Y, it is preferable to dispose the nozzle 4 on the upper side of the heat treatment tube 1.

An injection angle $\alpha$ between the steam injected from the steam injection opening 18 and the yarn Y (an angle relative to a plane perpendicular to the yarn Y) may be selected from a range of, preferably −60° to +60°, more preferably −30° to +30°. By selecting the injection angle $\alpha$ from the range, not only it is possible to increase the efficiency with which the yarn Y is heat-treated, but it is also possible to realize uniform heat treatment without blocking or disturbing steam which accompanies the yarn Y. The direction of injection of steam from the steam injection opening 18 is not limited to one direction, and it is also possible to adopt an arrangement in which steam is injected in a plurality of directions.

The orifice 5 which is inserted in the heat treatment tube 1 on the upstream side of the nozzle 4 is replaceably secured by a screw 14. The orifice 5 generates a large fluid resistance (pressure loss) by its throttling function, therefore, it is necessary to meter the flow of steam which flows from the heat insulating jacket 11 to the nozzle 4 to a constant level and effect a pressure reduction. The fluid resistance generated by the orifice 5 is set to be greater than the total fluid resistance based on the flow straightening part 15 and the steam injection opening 18 of the nozzle 4 which is located downstream of the orifice 5. The fluid resistance of the orifice 5 may be selected to be preferably not less than 5 times the total fluid resistance of the nozzle 4, more preferably not less than 10 times.

A valve disc 26 is disposed in opposing relation to a downstream opening of the orifice 5, and the valve disc 26 is arranged to open and close the opening 23 by the forward and backward operations of a valve stem 28. The valve disc 26 is used to temporarily close the orifice 5 so that steam is prevented from being supplied to the heat treatment area 7 during the operation of loading the yarn Y into the heat treatment tube 1. A projection 27 is integrally provided on the top of the valve disc 26. The length of the projection 27 is selected to be greater than at least the entire length of the orifice 5, and when the valve disc 26 is operated to move forward or backward, the projection 27 moves forward or backward over the entire length of the orifice 5, thereby removing drain, rust, deposit, etc., which adhere to the internal wall of the orifice 5 or the periphery of the opening of the orifice 5.

Although in the shown embodiment the opening of the orifice 5 is used as a valve seat for the valve disc 26, another larger-diameter opening may be provided on the downstream side of the opening of the orifice 5 so that it can be used as a valve seat for the valve disc 26 to constitute a valve independent of the orifice 5.

Although a single orifice 5 is formed, a plurality of orifices 5 may also be formed. If a plurality of orifices 5 are to be used, all of the orifices 5 may be of the same diameter or orifices having different diameters may be combined. By selecting the number and the diameters of such orifices, it is possible to select conditions for the pressure and the flow of steam from among a wide variety of conditions. The diameters of the orifices may be selected from a range of 0.5–2.5 mm, preferably 1.0–2.0 mm. By selecting any of the orifice diameters within such a range, it is possible to reduce the influence of impurities in steam or the deposition of scale.

Figure 4:
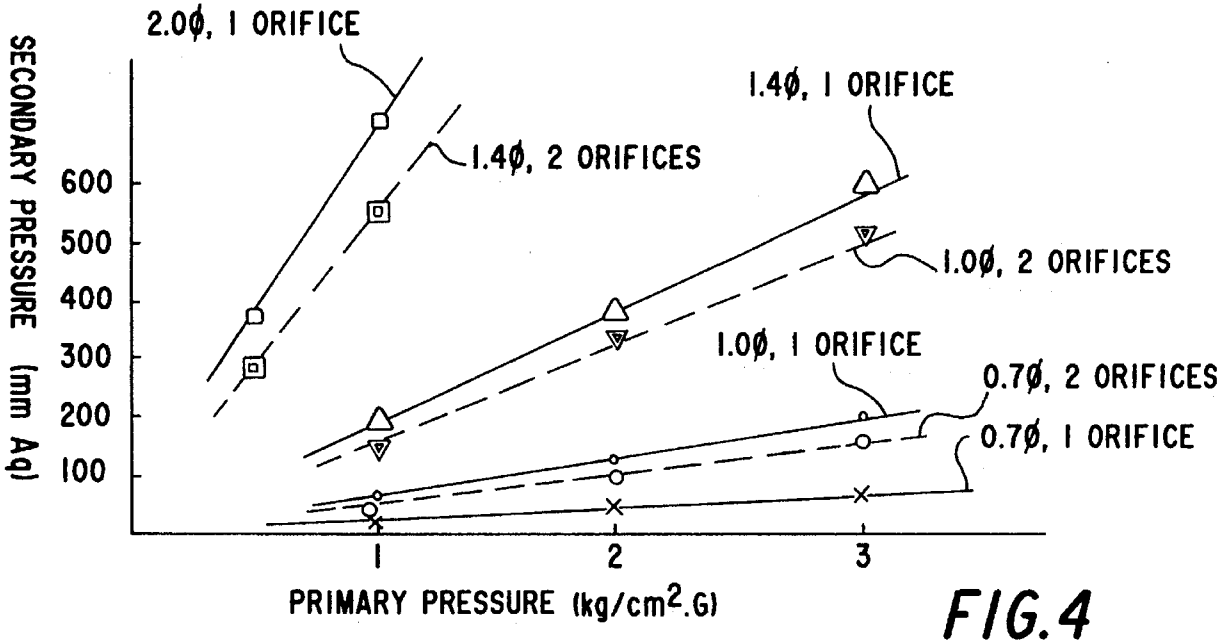
FIG. 4 is a diagram showing the relationships between the primary pressure and the secondary pressure of steam across an orifice of the apparatus of FIG. 1.

FIG. 4 shows the result obtained by measuring a primary pressure within the heat insulating jacket 11 against a secondary pressure within the nozzle 4 after the passage of steam through the orifices 5 with the diameters and the number of which varied for each of the measurements. The primary pressure was measured by using a Burdon tube pressure gauge, while the secondary pressure was measured by using an underwater manometer. As can be seen from the graph shown in FIG. 4, if the diameters and the number of the orifices 5 as well as the relationship between the primary and secondary pressures of steam are obtained in advance, it is possible to uniquely define a primary pressure from which to find a steam pressure (secondary pressure) required for the heat treatment area 7.

To facilitate the above-mentioned yarn loading operation, the heat treatment tube 1 is formed in such a manner that one side of the heat treatment area 7 is formed as an opening 22 which is open to the outside and extends along the running direction of the yarn Y, and the opening 22 is arranged to be opened and closed by a door 25. The door 25 has a packing 39 made of rubber on its inside and is mounted to the frame of the heat insulating jacket 11 via a hinge 40 in such a manner as to be able to open and close. The door 25 is also arranged to be locked by a latch 41. When the door 25 is opened, one side of the heat treatment area 7 is opened to the outside so that it is possible to readily perform the operation of loading the yarn Y. If the door 25 is closed, the packing 39 closes the opening 22 of the heat treatment area 7.

Figure 3:
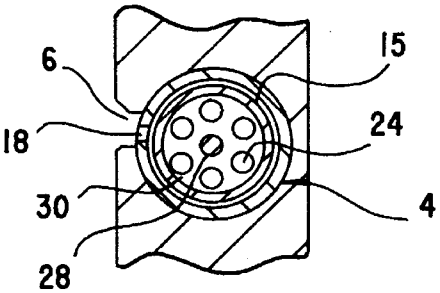
FIG. 3 is a cross-sectional view taken along line III—III of FIG. 2.

The valve stem 28 of the valve disc 26 for opening and closing the orifice 5 is interlockingly connected to the door 25. The valve stem 28 is disposed to extend along the axis of the nozzle 4, and the front end portion having the valve disc 26 is supported by a guide 30, while the rear end portion is supported by a seal member 20 and projects outwardly of the heat treatment tube 1. The seal member 20 is fitted with a rubber-made packing 29 for preventing leakage from a nip between the valve stem 28 and the seal member 20. The guide 30 has a plurality of through-holes 24 as shown in FIG. 3 so that steam supplied from the orifice 5 can be supplied to the inside of the nozzle 4. Since the valve stem 28 is placed on the downstream side of the orifice 5 on which steam pressure is lower, a simple structure can be adopted for the seal member 20 so that a cost reduction can be effected.

The end portion of the valve stem 28 which projects outwardly of the heat treatment tube 1 is pivotally supported by one end of a lever 33 which is pivotally supported by a pin 34 fixed to the outside wall of the heat treatment tube 1. The other end of the lever 33 is brought in abutment with the inside wall of the door 25. As the door 25 is closed, the inside wall forces the one end of the lever 33 inwardly and the other end of the lever 33 pulls the valve stem 28 outwardly to compress a spring 36, thereby separating the valve disc 26 from the opening 23 of the orifice 5. As the door 25 is opened, the pressure applied to the lever 33 is released, and the elastic force of the spring 36 forces the valve stem 28 toward the orifice 5 and the valve disc 26 provided at the front end of the valve stem 28 tightly seals the opening 23 of the orifice 5. When the door 25 is opened and closed in the above-described manner, if the door 25 is open, the orifice 5 automatically closes, while if the door 25 is closed, the orifice 5 automatically opens. Thus, the yarn loading operation can be facilitated.

Although in the above-described embodiment the operation of opening and closing the orifice 5 by means of the valve disc 26 is interlocked with the operation of opening and closing the door 25, these operations may also be executed independently of each other. Specifically, the end portion of the valve stem 28 which projects outwardly of the heat treatment tube 1 may also be operated independently of the door 25 by means of an operating mechanism, such as a cam mechanism or a solenoid mechanism.

Two pairs of guide plates 8, 8 and 8', 8' are respectively provided on the top and the bottom of the heat treatment tube 1 of the above-described heat treatment apparatus in such a manner that the yarn Y can pass through the gaps both between the guide plates 8 and 8 and between the guide plates 8' and 8'. Suction boxes 9 and 9' are respectively provided outwardly of the guide plates 8 and 8'. The guide plates 8 and 8' serve to prevent an air flow which accompanies the yarn Y from entering or leaving the heat treatment area 7. The suction boxes 9 and 9' are respectively connected to negative-pressure sources (not shown) by connecting pipes 17 and 17' so that steam or condensate which leaks out of the heat treatment area 7 is recovered by suction. It is desirable that the guide plates 8 and 8' and the suction boxes 9 and 9' be respectively arranged to be removably mounted by screws or the like.

It is preferable that widths $\epsilon$ and $\epsilon'$, which are formed between the pair of guide plates 8 and 8 and between the pair of guide plates 8' and 8', be selected to be as small as possible so that stable heat treatment can be performed by preventing occurrence of an accompanying air flow. However, if the widths $\epsilon$ and $\epsilon'$ are excessively small, the running resistance of the yarn Y increases, with the result that a lowering in the strength of the yarn Y may occur or an extreme abrasion of the guide plates 8 and 8' may be incurred. For this reason, it is necessary to set the widths $\epsilon$ and $\epsilon'$ to a size which is the smallest possible within a certain range. Although the widths $\epsilon$ and $\epsilon'$ of the pairs of guide plates 8 and 8' depend on the thickness of yarn, they may be selected from a range of, preferably 0.1–3.0 mm, more preferably 0.3–2.0 mm. As the material of the guide plates, a substance having abrasion resistance to yarn is desirable;

for example, ceramics or metal coated with ceramics are preferable.

It is more preferable that widths δ and δ' of yarn entrance and exit openings in the respective suction boxes 9 and 9' be made smaller to prevent occurrence of an air flow which accompanies the yarn Y. However, the widths δ and δ' need to be made greater than the widths ϵ and ϵ' of the guide plates 8 and 8'. If the widths δ and δ' of the suction boxes 9 and 9' are made smaller than the widths ϵ and ϵ' of the guide plates 8 and 8', the yarn Y comes into contact with the suction boxes 9 and 9' without contacting the guide plate 8 or 8', with the result that the meaning of the mounting of the guide plates 8 and 8' will be lost.

The yarn entrance and exit openings of the suction boxes 9 and 9' are each formed to have a funnel-shaped inclined face. The funnel-shaped inclined faces serve to prevent steam in the heat treatment area 7 from leaking to the outside and to prevent an outside air flow which accompanies the yarn Y from entering the heat treatment area 7. Open angles β and β' of the respective funnel-shaped inclined faces may be selected from a range of 30°–150°, preferably 60°–120°.

According to the heat treatment apparatus of the present invention having the above-described arrangement and construction, the steam S having the primary pressure which is regulated in advance by the pressure regulating valve 21 is supplied to the heat insulating jacket 11 through the supply pipe 2. Although the primary pressure depends on the kind of yarn and the processing conditions needed in the heat treatment area 7, it is desirable to control the primary pressure within a range of 0.5–5.0 kg/cm$^2$G.

The heat insulating jacket 11 plays the role of a condensate separator for the supplied steam. Specifically, the steam supplied from the supply pipe 2 may contain condensate, rust or the like which occurs midway in a pipe, but even if condensate, rust or the like is brought into the heat insulating jacket 11, it falls after striking against the internal wall of the heat insulating jacket 11. Thus, the condensate, the rust or the like can be discharged through the discharge pipe 3. The steam supplied to the heat insulating jacket 11 is also rapidly dispersed within the heat insulating jacket 11, and a portion of the dispersed steam flows into the nozzle 4 through the throttling part of the orifice 5. Accordingly, after the steam has been rapidly dispersed, the condensate, the rust or the like becomes substantially unable to follow a flow of stream which leaves the throttling part, and is therefore separated from the steam.

The steam of primary pressure which has been supplied to the heat insulating jacket 11 in the above-described manner is metered to a constant flow and reduced in pressure by the throttling function of the orifice 5. After that, the steam is injected into the heat treatment area 7 through the steam injection opening 18 of the nozzle 4. Before the steam is injected through the steam injection opening 18 of the nozzle 4, the flow of the steam is straightened by passing it through straightening part 15 of multi-holed structure. Accordingly, the steam is injected toward the yarn Y of belt-like form at a uniformly distributed flow speed.

In the above-described manner, the steam supplied to the inside of the heat insulating jacket 11 is metered to a constant flow and reduced in pressure by the throttling function of the orifice 5, and the resultant steam is injected toward the yarn Y. Accordingly, it is possible to attain the great advantage that the regulation of the primary pressure of steam to be supplied to heat insulating jackets provided for a plurality of spindles can be controlled by the common pressure regulating valve 21.

If the yarn Y is to be heat-treated by injecting steam having a low pressure close to atmospheric pressure into the heat treatment area 7, since the orifice 5 is replaceable, it is only necessary to select the opening diameter of the orifice 5 on the basis of a required pressure and replace the orifice 5 with an optimum one. After that, by controlling only the primary pressure of the steam being supplied to the heat insulating jacket 11, it is possible to automatically obtain the required pressure. Further, since condensate is separated from the steam in the heat insulating jacket 11 in advance, the steam, containing no condensate can be used for heat treatment of the yarn Y. Accordingly, even if steam to be supplied to the heat insulating jacket 11 contains condensate, it is possible to reduce variations in pressure, temperature, flow rate and the like to extremely small levels.

In the arrangement of the embodiment in which the orifice 5 is integrally and replaceable secured to the nozzle 4, even if individual differences are present among spindles, optimum orifices for the respective spindles can be readily set, so that it is possible to reduce the individual differences among the spindles by adjusting the orifice for each of the spindles. Also, even if scale or rust which occurs midway in a pipe reaches the orifice intact and clogs the orifice 5, since the orifice 5 is replaceable, it is possible to restart running within a short time.

Also, in the embodiment, since the nozzle 4 is mounted in the state of being surrounded by the heat insulating jacket 11, condensation can be prevented from occurring in steam, during the straightening thereof in the nozzle 4, by the heating action of the heat insulating jacket 11. Also, even if condensate enters the nozzle 4 together with steam immediately after the start of a running when the heat treatment tube 1 is not yet sufficiently heated, the drain evaporates in the nozzle 4 as the temperature of the heat insulating jacket 11 rises. Accordingly, it is possible to eliminate the condensate from the steam injected into the heat treatment area 7.

Figure 6:
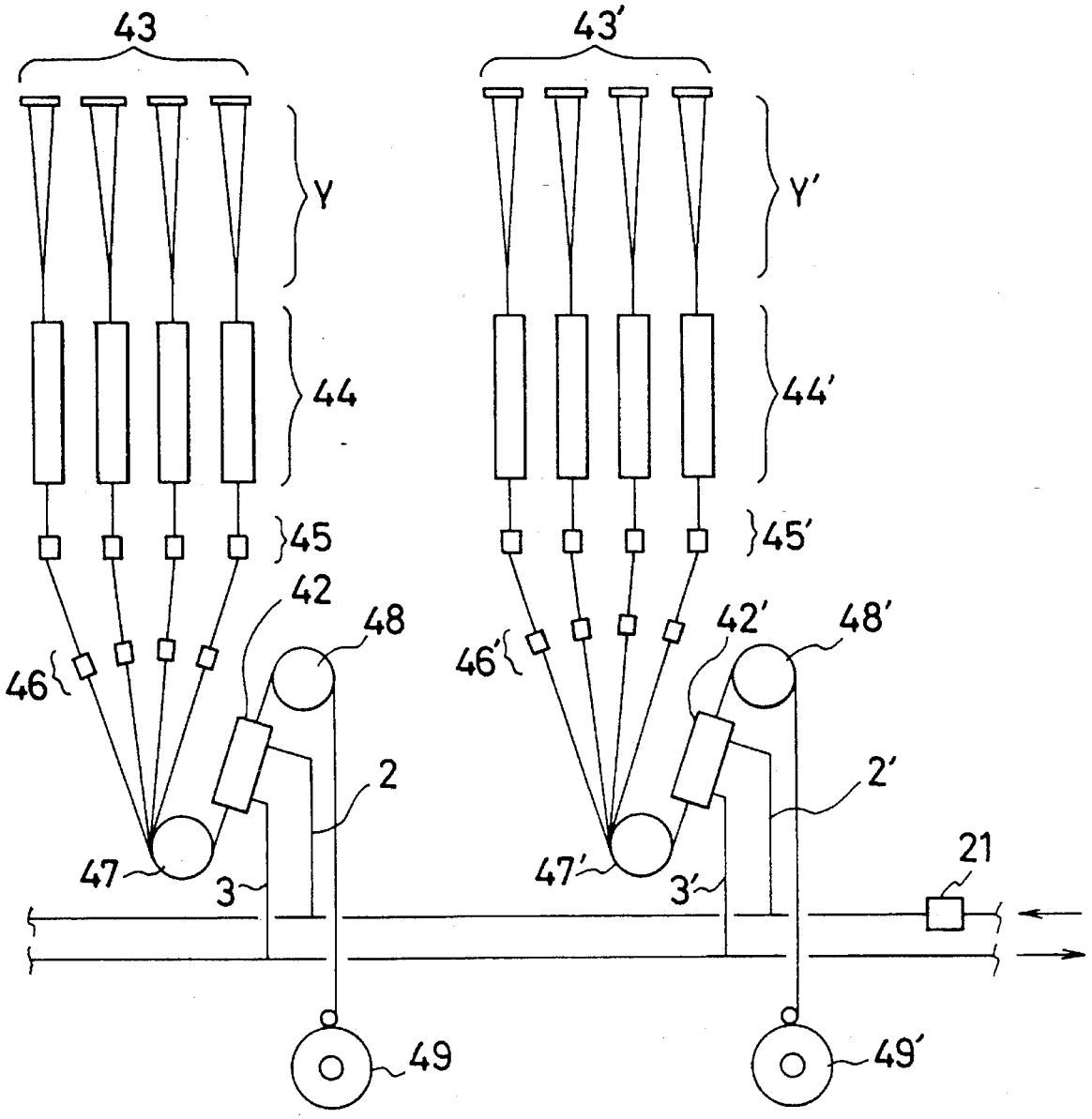
FIG. 6 is a diagrammatic view showing one example of a synthetic fiber producing process to which a heat treatment apparatus for yarn according to the present invention is applied.

FIG. 6 shows one example in which the heat treatment apparatus according to the present invention is employed in a yarn spinning process. Although two spindles are shown in FIG. 6 for convenience's sake, a multiplicity of spindles are provided in practice.

In the yarn spinning process, the yarn Y and yarn Y' are respectively discharged through spinneret 43 and 43' and cooled to a temperature close to a glass transition point. The yarns Y and Y' pass through heating tubes 44 and 44', and oil is applied to the yarns Y and Y' in oil feeding apparatuses 45 and 45'. After interlacing has been applied to the yarns Y and Y' in interlacing applying apparatuses 46 and 46', the respective yarns Y and Y' are wound on packages 49 and 49' via godet rolls 47, 47' and 48, 48'. In the heating tubes 44 and 44', the respective yarns Y and Y' are heated by heated fluids and stretched by tensile forces according to the speeds of the godet rolls 47 and 47'.

If the yarns Y and Y' are directly wound on the packages 49 and 49', residual strains which have occurred during stretching in the heating tubes 44 and 44' remain in the yarns Y and Y' and cause shrinking forces in the packages 49 and 49'. As a result, the yarns Y and Y' are excessively tightly wound on the packages 49 and 49' and it becomes impossible to release (rewind) the yarns Y and Y'.

For this reason, heat treatment apparatuses 42 and 42' according to the present invention are disposed between the godet rolls 47 and 48 and between the godet rolls 47' and 48', respectively, whereby the ratios of shrinkage of the yarns Y and Y' are lowered by heat-treating the yarns Y and Y' with the tensions of the yarns Y and Y' placed in a relaxed state of not greater than a predetermined value. Thus, it is possible to prevent excessively tight winding from occurring in the packages 49 and 49'.

The plurality of heat treatment apparatuses 42 and 42' are each arranged in such a manner that the amount of steam injected into the heat treatment area 7 is regulated to a constant level for each spindle by the above-described orifice 5. Accordingly, by regulating only the pressure regulating valve 21, it is possible to mutually uniformly heat-treat the yarns Y and Y' and realize stable yarn quality. Even if a yarn break occurs in a particular spindle (for example, a spindle associated with the heat treatment apparatus 42) and the supply of steam to the heat treatment apparatus 42 is stopped, the pressure is held at a constant valve by the functions of the pressure regulating valve 21 and the orifice 5, whereby production can be continued without exerting any influence on the heat treatment apparatus 42' provided for another spindle. Also, if yarn is rethreaded and the running of the heat treatment apparatus 42 is restarted, the heat insulating jacket 11 functions as a buffer so that smooth production can be performed without exerting influence on another spindle.

EXAMPLE

Heat treatment apparatuses (Nos. 1, 2, 3 and 4) for four spindles were prepared. Each of the heat treatment apparatuses had the arrangement shown in FIGS. 1 and 2, and its respective heat treatment area, orifice and nozzle had the following specifications. The pressure drop across each of the orifices was set to approximately thirty times as large as the total pressure drop.

Heat treatment area: 300 mm high×20 mm wide×110 mm deep

Orifice: 2 mm in diameter (tolerance: +0.05–0 mm)

Hole of valve stem guide: 3.0 mm in diameter×6

Nozzle: Injection opening=2.0 mm×52 mm Hole of flow straightening part=2.0 mm in diameter×4

The heat treatment apparatuses for four spindles were respectively connected to pipes which branched from a single pressure regulating valve. The primary pressure was set to 0.4 kg/cm$^2$G, respectively 0.8 kg/cm$^2$G and 1.4 kg/cm$^2$G by the pressure regulating valve. Steam was supplied to the heat treatment areas of the respective heat treatment apparatuses at each of the primary pressures, and variations in steam flow rate among the spindles for each of the primary pressures were measured after the passage of two hours. The results shown in the following table were obtained.

Incidentally, the steam flow rates were measured as an increment (g/minute) in the amount of drain while steam leaking through one yarn passage hole of the heat treatment area was being introduced into water with the other yarn passage hole closed with tape. The pressure of each of the heat treatment areas was approximately 300 mm Aq.

TABLE

| | Spindle | Primary pressure (kg/cm$^2$G) | | |
|---|---|---|---|---|
| | No. | 0.4 | 0.8 | 1.4 |
| Steam flow rate (g/min.) | No. 1 | 22.7 | 33.5 | 45.4 |
| | No. 2 | 23.9 | 34.1 | 46.6 |
| | No. 3 | 23.9 | 34.7 | 47.2 |
| | No. 4 | 24.5 | 35.3 | 48.4 |

As can be seen from the result shown in the table, the variations in steam flow rate among the respective spindles fall with in a substantially satisfactory range. The operation of opening and closing the door of each of the heat treatment apparatuses was performed at constant time intervals and the flow rates before and after the respective operations were checked without making any regulation of the flow rates. However, no significant variation in flow rate was observed.

Then, the aforesaid heat treatment apparatuses were prepared for sixty-four spindles, and each of the heat treatment apparatuses was set as a heat treatment apparatus 42 in the yarn spinning apparatus shown in FIG. 6. The speed of the godet roll 47 was set to 5,000 m/min, and the yarn Y was subjected to heat treatment at a relaxation ratio of 1.9% and was wound on the package 49. Thirty-two packages were sampled from the obtained sixty-four packages, and their shrinkage ratios and dyeing speck were measured. There were no differences in shrinkage ratio and dyeing speck among the packages (spindles) and the yarn qualities of all the packages were uniform.

Industrial Applicability

The heat treatment apparatus according to the present invention described above can be used as heat treatment means for stretching or heat-fixing yarn in a yarn spinning process using a plurality of spindles or as heat treatment means in a twisting process using a plurality of spindles. Such a heat treatment apparatus including a plurality of spindles can be usefully employed in applications which require an apparatus capable of providing uniform yarn quality and efficient yarn loading operation.

What is claimed is:

1. A heat treatment apparatus for yarn, including heat treatment apparatuses provided for a plurality of spindles disposed at horizontally spaced intervals, wherein each of said heat treatment apparatus provided for each of said plurality of spindles comprises:

(a) at least one heat treatment tube having in its inside a heat treatment area through which at least one yarn passes;

(b) a heat insulating jacket operatively associated with and surrounding each of said heat treatment tubes;

(c) a supply pipe connected between a supply of a heated fluid and each of said heat insulating jackets;

(d) pressure regulating means operatively associated with said supply pipe and a plurality of said heat insulating jackets;

(e) means communicating between said heat treatment tube and said heat insulating jacket;

(f) a nozzle provided down-stream of said communication means, said nozzle having an injection opening which is open to the heat treatment area of said heat treatment tube and having, in its inside, means for straightening the heated fluid; and (g) an orifice provided upstream of said communication means having a fluid resistance greater than a fluid resistance of said nozzle.

2. A heat treatment apparatus for yarn according to claim 1, wherein a valve for opening and closing said orifice is provided downstream of said orifice.

3. A heat treatment apparatus for yarn according to claim 2, wherein said valve includes a valve seat using an opening of said orifice and a valve disc movable into and out of contact with the valve seat, a projection which extends through said orifice being integrally provided on a top of the valve disc, and a valve stem connected to the valve disc being provided opposite to the top.

4. A heat treatment apparatus for yarn according to claim 1, wherein a slit-shaped opening, which extends along a running direction of the yarn, is provided on one side of the heat treatment area of said heat treatment tube, and a door is provided for opening and closing the opening.

5. A heat treatment apparatus for yarn according to claim 3, wherein a slit-shaped opening, which extends along a running direction of the yarn, is provided on one side of the heat treatment area of said heat treatment tube, and a door is provided for opening and closing the opening, the valve stem being interlockingly connected to the door in such a manner that the valve disc opens and closes said orifice by opening and closing operations of the door.

6. A heat treatment apparatus for yarn according to claim 1, wherein said nozzle is substantially surrounded by said heat insulating jacket.

7. A heat treatment apparatus for yarn according to claim 1, wherein said nozzle is replaceably secured.

8. A heat treatment apparatus for yarn according to claim 6, wherein said nozzle is replaceably secured.

9. A heat treatment apparatus for yarn according to claim 1, wherein a suction box, for sucking a flow of fluid which accompanies the yarn, is provided at a yarn entrance opening of said heat treatment tube.

10. A heat treatment apparatus for yarn according to claim 1, wherein a suction box, for sucking a flow of fluid which accompanies the yarn, is provided at a yarn exit opening of said heat treatment tube.

11. A heat treatment apparatus for yarn according to claim 9, wherein a suction box, for sucking a flow of fluid which accompanies the yarn, is provided at a yarn exit opening of said heat treatment tube.

* * * * *